US006922895B1

(12) United States Patent
Whitworth

(10) Patent No.: US 6,922,895 B1
(45) Date of Patent: Aug. 2, 2005

(54) APPARATUS FOR THE PRODUCTION OF POCKETED COIL SPRINGS

(75) Inventor: Ian James Whitworth, Belper (GB)

(73) Assignee: Springform Technology Limited, Long Eaton (GB)

( * ) Notice: Subject to any disclaimer, the term of this patent is extended or adjusted under 35 U.S.C. 154(b) by 0 days.

(21) Appl. No.: 09/647,087

(22) PCT Filed: Mar. 29, 1999

(86) PCT No.: PCT/GB99/00975

§ 371 (c)(1),
(2), (4) Date: Dec. 7, 2000

(87) PCT Pub. No.: WO99/50175

PCT Pub. Date: Oct. 7, 1999

(30) Foreign Application Priority Data

Mar. 31, 1998 (GB) ..... 9806778

(51) Int. Cl.[7] ..... B21F 35/00
(52) U.S. Cl. ..... 29/896.92; 29/33 F; 29/33 Q
(58) Field of Search ..... 29/896.92, 896.9, 29/429, 430, 446, 469, 469.5, 527.1, 561, 29/564.1, 33 F, 33 K, 33 Q

(56) References Cited

U.S. PATENT DOCUMENTS

| | | | | |
|---|---|---|---|---|
| 4,112,721 | A * | 9/1978 | Takase et al. | |
| 4,439,977 | A * | 4/1984 | Stumpf | 53/428 |
| 5,444,905 | A * | 8/1995 | St. Clair | 29/33 F |
| 5,452,598 | A | 9/1995 | Cheng | |

* cited by examiner

*Primary Examiner*—Irene Cuda Rosenbaum
(74) *Attorney, Agent, or Firm*—Nixon Peabody LLP

(57) ABSTRACT

An apparatus for the production of pocketed coil springs is disclosed. The apparatus includes a coiling section in which a coil is formed from wire fed to the coiling section, the coiling section including coiling elements, whose position and/or orientation determines the form of the coil, and an encapsulation section in which the coil is inserted between juxtaposed sheets of material and in which the sheets of material are joined together to form a pocket enclosing the coil. The apparatus further includes programmable control means operably linked to the coiling elements in such a way as to control the position and/or orientation of the coiling elements.

21 Claims, 4 Drawing Sheets

APPARATUS FOR THE PRODUCTION OF POCKETED COIL SPRINGS

CROSS REFERENCE TO RELATED APPLICATIONS

This application is a 35 U.S.C. §371 of PCT/GB99/00975, filed Mar. 29, 1999, and claims priority from U.K. Patent Application No. 9806778.8, filed Mar. 31, 1998, both of which are hereby incorporated by reference in their entirety.

FIELD OF THE INVENTION

This invention relates to apparatus and methods for the production of pocketed coil springs, and to pocketed spring assemblies.

BACKGROUND OF THE INVENTION

Pocketed coil springs, ie strings of springs enclosed within fabric pockets which are joined at their side seams, are widely used in the manufacture of mattresses, cushions and the like.

Apparatus for the production of pocketed coil springs may generally be regarded as comprising two sections: a coiling unit in which the coil is formed and an encapsulation section in which the coil is inserted between two layers of material which are then joined together to form a pocket enclosing the spring.

The coiling of the wire is commonly achieved by the interaction of three components: feed rollers which pull the wire through the coiler, a so-called "finger" which governs the diameter of the spring as it forms and a so-called "spreader" which controls its pitch. The relative movements of these components define the pattern of the spring that is formed.

Conventionally, synchronisation is achieved by a complex arrangement of gears and cams, making resetting between one product and another a lengthy operation needing high levels of training and experience. Consequently, economic batch quantities are high and response to special customer requirements is slow. Development of new spring designs is difficult, often relying on the creation of new cam profiles on a trial and error basis. In addition, the maximum length of spring which can be produced is often severely limited.

The encapsulation section relies on the insertion of the fully compressed springs between the sheets of material, most commonly a folded sheet of non-woven fabric, which are then sewn or welded together to produce the individual pocketed springs. Synchronisation of this section is also dependent on mechanical devices such as cams, linkages and a clutch all of which require resetting between products, with resulting loss of productivity and high maintenance costs.

There have now been devised improvements to apparatus and methods for the production of pocketed coil springs which overcome or substantially mitigate the above-mentioned disadvantages.

SUMMARY OF THE INVENTION

According to a first aspect of the invention, apparatus for the production of pocketed coil springs comprises a coiling section in which a coil is formed from wire fed to the coiling section, said coiling section comprising coiling elements whose position and/or orientation determines the form of said coil, and an encapsulation section in which the coil is inserted between juxtaposed sheets of material which are joined together to form a pocket enclosing the coil, wherein said apparatus further comprises programmable control means operably linked to said coiling elements thereby to control the position and/or orientation thereof.

The apparatus according to the invention is advantageous primarily in that the programmable control means may synchronise all operations of the apparatus, thereby eliminating change gears, cams, clutch etc. The time to change between products is reduced to seconds rather than hours, with consequential benefits to productivity and responsiveness, better quality, smaller batch quantities and reduced work in progress stocks. Development of new products and extensions of the product range can be achieved far more easily without any significant loss of time or materials.

According to another aspect of the invention, there is provided a method of producing pocketed coil springs, which method comprises the steps of a) setting the positions and/or orientations of coiling elements in the coiling section of apparatus in accordance with the first aspect of the invention,
b) feeding wire through the coiling section so as to form a coil,
c) separating said coil from said wire,
d) compressing said coil,
e) inserting said coil between juxtaposed sheets of material, and
f) joining said sheets of material together so as to encapsulate said coil.

The programmable control means preferably comprises a programmable logic controller by which computer-numerical-control (CNC) of the coiling section is achieved. Preferably, the logic controller actuates drive means, most preferably servo motors by which the positions and/or orientations of the coiling elements can be altered.

Most preferably, control of the coiling unit is exerted by three servo motors: one for the wire feed rolls, one for a coiling element ("finger") which controls the diameter of the spring, and one for a coiling element ("spreader") which controls the pitch of the spring.

Most preferably, the control means stores a number of data arrays or tables which determine the position of the finger and spreader (slave) axes in relation to the position of the feed roller (master) axis, for each spring profile. Suitable tables may be prepared for each spring type to be manufactured, and the appropriate table selected prior to commencement of manufacture of any particular spring type.

Each table may consist of many data points, eg several thousand data points, resulting in complete control of the spring being formed. In order to facilitate the creation and modification of the tables, they can be created using a computer spreadsheet. This also enables viewing of a graphical representation of the movements of the axes relative to each other prior to the table being downloaded to the logic controller. The use of spreadsheets allows total flexibility in the desired spring profile, eg for development purposes. However, for established spring designs, it may simply be adequate to enter the desired pitch and diameter(s).

Any additional spring parameters, eg the number of convolutions or diameter modifications, may be entered directly via a control panel. This enhances changeovers and allows simple correction for variation in wire properties etc.

After each spring has been formed, the feed roll axis servo motor preferably stops completely to allow the wire to be cut, eg by a pneumatic cutter. This is in contrast to a traditional coiling machine where, owing to the inertia in the system, the wire movement is paused by moving the rolls apart from each other whilst they continue to rotate. This requires considerably more moving parts which are prone to mechanical failure.

The apparatus of the present invention makes it possible to achieve higher production speeds than with a conventional coiler. When producing longer springs, this higher speed can lead to instability in the spring as it is being formed which can result in machine stoppages. This problem can be reduced or eliminated by damping excessive oscillations of the springs. This can be achieved by providing magnetic means at the exit of the coiling unit. The magnet means engages the spring as it leaves the coiling unit, thereby damping oscillations of the spring and enabling springs of greater length to be produced. This in turn enables pocketed spring assemblies of greater depth to be manufactured with increased comfort for users of mattresses or the like incorporating such assemblies. The provision of such magnetic damping means at the exit of the coiler is believed to be novel and represents a further aspect of the invention.

Preferably, the magnet means comprises one or more electromagnets, and preferably the spring is mechanically drawn from the magnet means as it is conveyed to the encapsulation section.

The invention enables the production of longer springs, and hence deeper pocketed spring assemblies than has hitherto been possible. Thus, according to another aspect of the invention, there is provided a pocketed spring assembly having a depth of 20 cm or more. The depth of the pockets could be as much as 30 cm or even more in some applications, typical depths being approximately 21 cm, 24 cm and 25 cm. Because the springs in such spring assemblies are constrained within the pockets in a somewhat compressed state, the length of the spring itself, in a non-compressed condition, will be somewhat greater than the pocket depth. A spring for use in a 21 cm deep pocket might, for example, have a non-compressed depth of about 25 cm.

Preferably, the programmable control means is also operably linked to the encapsulation section, in particular to control movement of material through that unit. Most preferably, a further servo motor controls movement of the material, the increment of that motor corresponding to the desired pocket width, which can thereby be automatically adjusted to suit the spring diameter.

The means by which the springs are transferred to the encapsulation unit and inserted between the sheets of material may be generally conventional. Preferably, the springs are loaded onto successive radial arms of a rotating wheel. The springs are preferably mechanically compressed as they are conveyed to the encapsulation section so that they are substantially fully compressed when inserted between the sheets of material. Most preferably, the compressed spring is transferred to a reciprocating cassette within which it is transported to the encapsulation section.

The material in which the pockets are formed may have any suitable form. For example, the material may be either a non-woven or woven fabric. The pockets in the fabric may be formed by any suitable means. Such means include stitching, but it is preferred to form the pockets by thermal welding of the two sheets of material. For this reason, it is preferred that the material be of a fabric which is thermoplastic, and in particular that it be of a non-woven thermoplastic material. One suitable material is a non-woven polypropylene. Most preferably, the two sheets of material are formed by folding of a single sheet having a width approximately double the desired depth of the pockets. In such a case, each pocket is defined between two transverse welds and one longitudinal weld which closes the open end of the pocket through which the spring has been inserted.

Welding of the two sheets of material can be carried out in any suitable fashion. However, it is preferred to use ultrasonic welding. The welds are preferably interrupted, rather than continuous, and are therefore most preferably formed using ultrasonic welding horns with suitably formed, eg castellated, lower edges.

It is particularly preferred that each transverse weld be formed by a plurality, most preferably a pair, of castellated welding horns, and in particular by a plurality of welding horns arranged side-by-side, ie with their lower edges arranged colinearly. This arrangement is believed to be novel and represents a further aspect of the present invention, as does a method of producing pocketed coil springs which utilises such an arrangement. It enables production of significantly deeper pocket units, whilst maintaining commonality of spares etc. Moreover, should there be any wear of the welding horn caused by misaligned springs this will be restricted to the adjacent ends of the two horns, which can in time be turned through 180°, avoiding the need to regrind them.

The transverse welds need to be formed at a separation from the centre of the springs, as they are introduced into the encapsulation section, which is equal to an integral number of pocket widths plus one-half of the pocket width. Since the pocket width may be changed to accommodate a different type of spring it is preferred that the position of the welds be adjustable to satisfy this requirement. Thus, means are preferably provided for alteration of the position of the position of the transverse welding means relative to the point of insertion of the springs into the encapsulation unit. In general, if the welds are to be formed at a distance of (n+0.5) times the pocket width (where n is an integer) then the position of the welding means needs to be adjustable in a range (n+0.5) times the difference between the smallest and greatest pocket widths which are to be formed. For example, if the pocket width varies between 8 cm and 10 cm, and the welds are formed 2.5 pocket widths from the point of encapsulation of the springs, then the welding means need to displaceable over a range of at least 5 cm.

The welding means may be slidably mounted on suitable guide rails and may be driven by a suitable rack and pinion mechanism or the like. The required position of the welding means may be calculated automatically by the control means, and the position of the welding means may be altered automatically, or the required position may be displayed and the welding means positioned manually.

The fixed anvil onto which the or each welding horn presses the material is preferably provided with a surface coating which acts as a cushion for the welding horn, leading to a more consistent weld and enabling the use of lighter fabrics than is otherwise the case. Again, such an arrangement is believed to be novel and represents a further aspect of the invention. The surface coating is preferably a tape applied to the surface of the anvil. The tape is most preferably a polytetrafluoroethylene (PTFE) tape.

The pockets are preferably completed by longitudinal welds formed by a welding horn disposed parallel to the direction of travel of the fabric.

Most preferably, the material is drawn through the encapsulation section by means of rollers. It is preferred that the material pass between a pair of horizontally disposed rollers, one of which is driven by a servo motor controlled by the control means. Such rollers are preferably located downstream of the welding means. Most preferably the rollers have rubberised surfaces to improve engagement of the rollers with the fabric.

Other components of the apparatus, downstream of the welding horns, may be generally conventional. Such components may include a worm gear which rotates transverse to the direction of travel of the completed pockets and which serves to orient the springs as they expand within the pockets.

BRIEF DESCRIPTION OF THE DRAWINGS

The invention will now be described in greater detail, by way of example only, with reference to the accompanying drawings, in which.

DETAILED DESCRIPTION OF THE INVENTION

Figure 1:
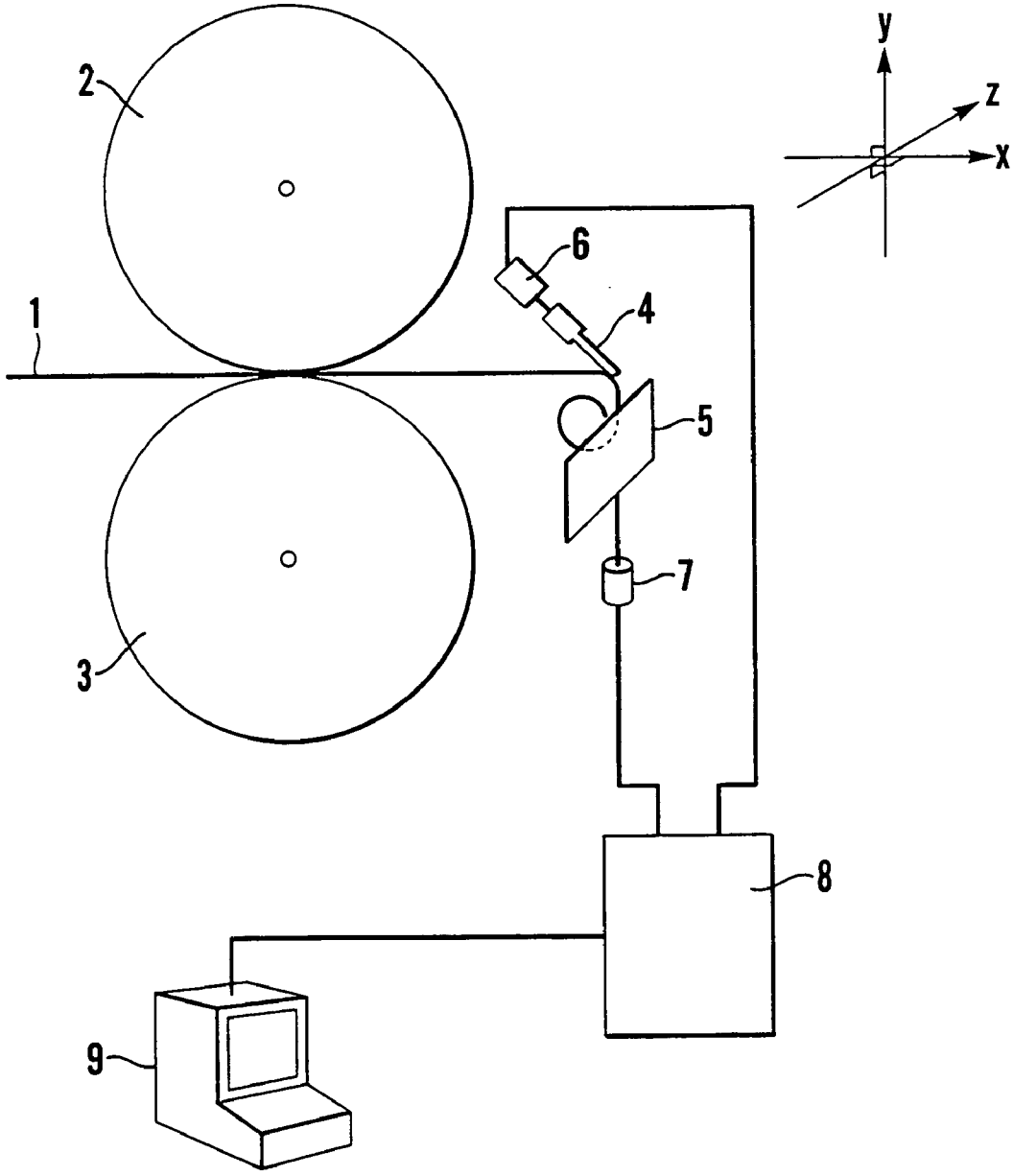
FIG. 1 is a diagrammatic view of a coiling unit forming part of an apparatus according to the invention.

Referring first to FIG. 1, a coiling unit of an apparatus according to the invention is shown schematically and comprises three components which determine the form of the coil produced from wire 1 fed into the unit by conventional means. Those three components are a pair of feed rollers 2,3, a coiling finger 4 and a so-called spreader 5. The feed rollers 2,3 determine the axis along which the wire is fed to the finger 4 and spreader 5. This is the master axis in relation to which the orientational axes (slave axes) of the finger 4 and spreader 5 are adjusted. The orientation of the finger 4 and spreader 5 are governed by servo-motors 6,7 which are controlled by a programmable logic controller (PLC) 8. The PLC 8 is in turn linked to a computer control panel 9. Connection of the control panel 9 to the PLC 8 may be necessary only some of the time, eg for downloading of data to the PLC 8 or monitoring operation of the PLC 8. At other times, eg during normal operation, such connection may be unnecessary.

Figure 2:
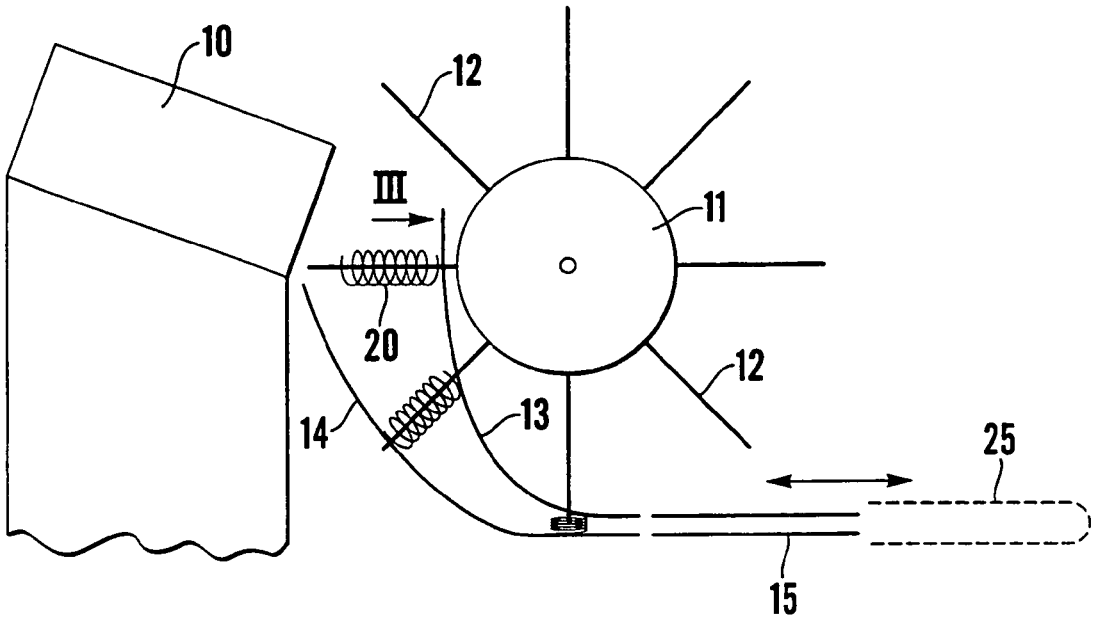
FIG. 2 is a schematic view of the coiling unit and spring transfer assembly forming part of the apparatus.

FIG. 2 shows a transfer mechanism by which coils produced in the coiling unit (generally designated in FIG. 2 by the numeral 10) are fed to an encapsulation section described below. The transfer mechanism comprises a counter-clockwise rotating wheel 11 with eight radially extending arms 12. Rotation of the wheel 11 is synchronised with the operation of the coiling unit 10 such that springs 20 produced in the coiling unit 10 are fed automatically onto the arms 12 as the arms 12 pass the exit from the coiling unit 10.

As the wheel 11 rotates further, the arms 12 carrying the springs 20 pass along longitudinal slots in a pair of compression plates 13,14, the space between which is progressively reduced, causing the springs 20 to be compressed. The terminal portions of the compression plates 13,14 are disposed parallel and horizontally so as to constitute a delivery chute from which the compressed springs 20 are delivered to a reciprocating cassette 15 which moves as indicated by the double-headed arrow. The cassette 15 transfers the springs 20 to the encapsulation unit and in particular to the space between the two leaves of a folded sheet of non-woven fabric 25 (shown in broken lines). When the cassette 15 is located between the leaves of fabric 25, a pneumatically driven rod 16 is raised and engages the spring 20 through the lower leaf and a slot in the base of the cassette 15. This rod 16 retains the spring 20 in position when the cassette 15 is withdrawn from the fabric 25.

Figure 3:
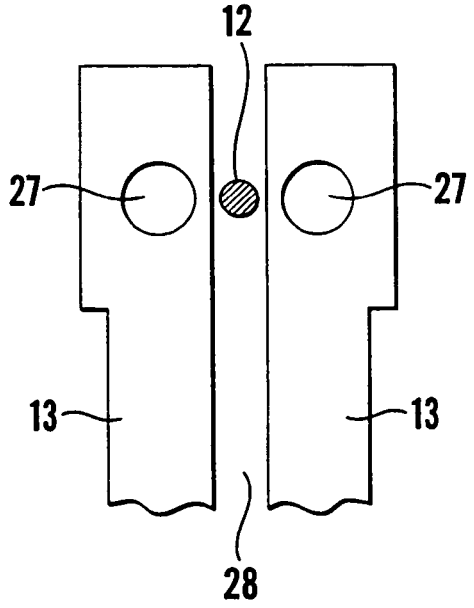
FIG. 3 is a detailed scrap view on the line III in FIG. 2.

Excessive oscillations of the springs 20 as they exit the coiling unit 10 and are loaded onto the arms 12 are prevented by a pair of electromagnets 27 (see FIG. 3) mounted on the topmost parts of the upper compression plate 13, either side of the longitudinal slot 28 running down the centre of that compression plate 13. The electromagnets 27 hold each spring 20 as it exits the coiling unit 10 until the corresponding arm 12 of the wheel 11 transports the spring 20 away.

Figure 4:
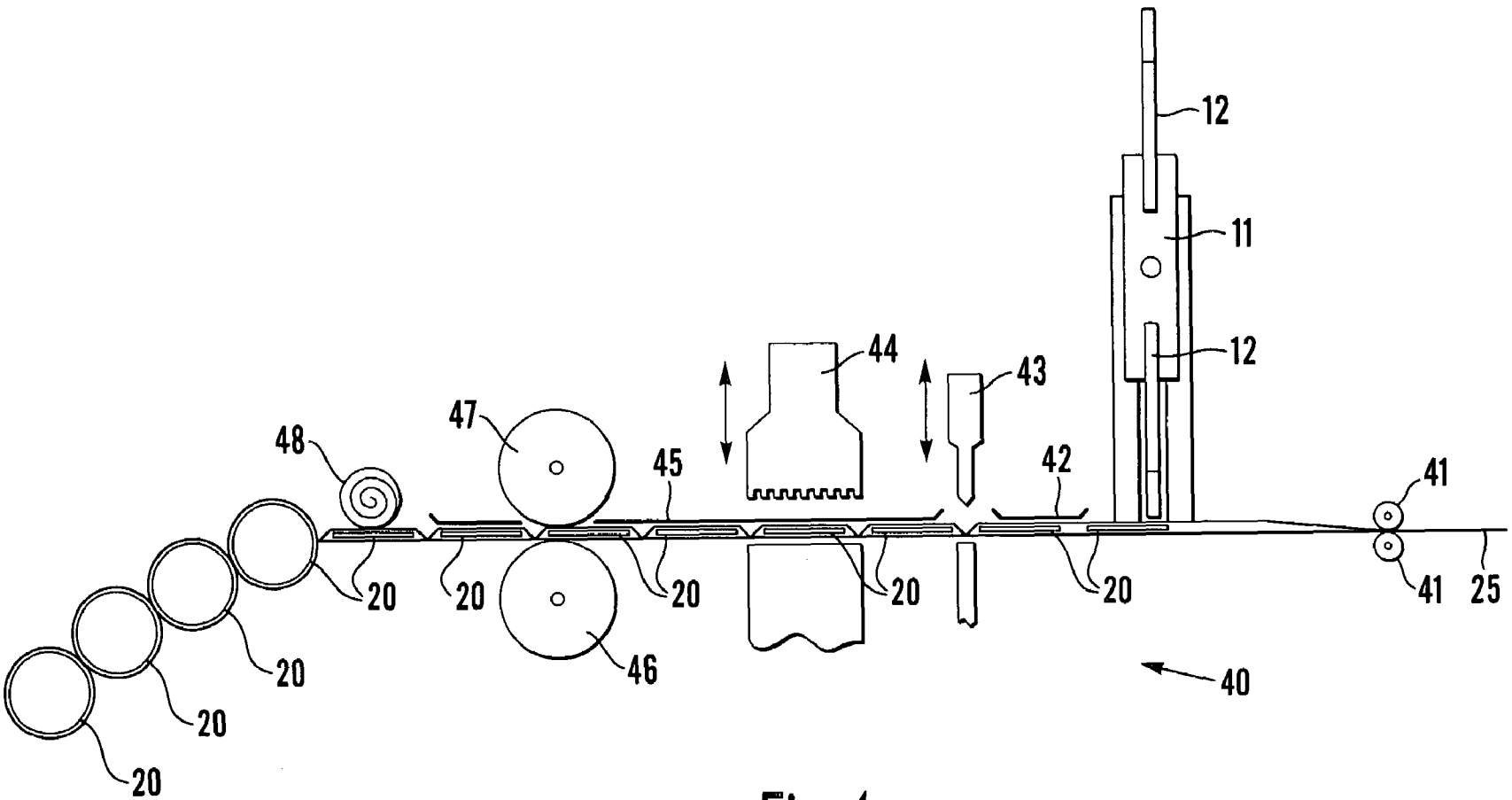
FIG. 4 is a schematic view of an encapsulation section forming part of the apparatus.

FIG. 4 shows the encapsulation unit 40, the operating axis of which is disposed perpendicular to that of the coiling unit 10. The sheet 25 of fabric is folded by conventional means (not shown) and fed through the encapsulation unit 40 from right to left, as viewed in FIG. 4, and in incremental steps. The sheet 25 passes first between a pair of guide rollers 41. A fixed separating guide (not shown) then parts the two leaves of the sheet 25 sufficiently for a spring 20 to be inserted between them as described above. The sheet 25 is then transported forward by one increment, so that the next spring 20 can be delivered into the space between the leaves of the sheet 25 from the next arm 12 of the wheel 11.

The spring 20 is maintained in a compressed condition by a cover plate 42 which, together with the bed of the encapsulation unit 40, defines a channel through which the encapsulated springs 20 are transported.

Following incremental travel of the sheet 25, the two leaves of the sheet 25 are joined by transverse welds formed by a first reciprocating welding horn arrangement 43 which is described more fully below. A further welding horn 44 forms a longitudinal weld which completes the encapsulation of the springs 20.

A second cover plate 45 extends from the region of the first welding horn arrangement 43, past the further welding horn 44 and also past a drive roller arrangement 46,47 which acts on the folded fabric sheet 25 so as incrementally to draw the sheet 25 through the encapsulation unit 40. The drive roller arrangement 46,47 comprises a driven roller 46 which acts on the underside of the sheet 25 and a second roller 47 which is pneumatically pressurised into engagement with the upper surface of the sheet 25. Both rollers 46,47 have rubberised surfaces, the thickness of the rubberised surface of the upper roller 47 being partly cut away to accommodate the second cover plate 45.

As the encapsulated springs 20 emerge from the channel between the second cover plate 45 and the bed of the encapsulation unit 40 they expand and are rotated into the desired orientation, in which the spring axis is transverse to the pockets, by a rotating worm 48. The finished product has the form of a string of springs enclosed within pockets formed in the non-woven fabric, the pockets being connected at the weld lines which define the sides of the pockets.

The reciprocating motion of the first welding arrangement 43 and of the further welding horn 44 is synchronised with the incremental actuation of the drive roller arrangement 46,47 again under the control of the PLC 8.

Figure 5:
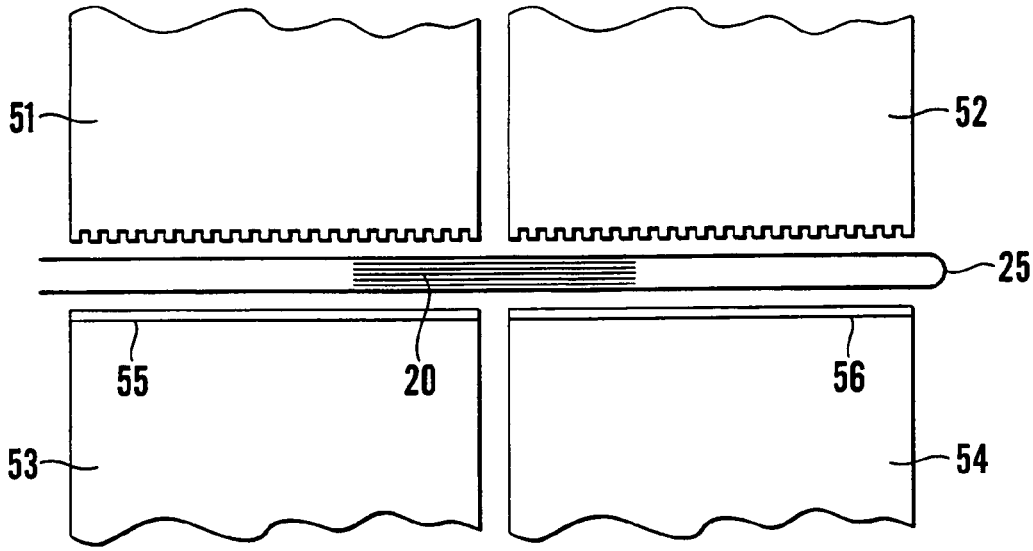
FIG. 5 is a front schematic view of a transverse ultrasonic welding arrangement forming part of the encapsulation section of FIG. 4.

As shown in FIG. 5, the first welding arrangement 43 comprises a pair of ultrasonic welding horns 51,52 arranged side by side. The horns 51,52 reciprocate on a vertical axis, and at the lowest point of their travel press the fabric sheet 25 onto a corresponding pair of anvils 53,54. The folded sheet 25 of fabric, with a spring 20 inserted between the two leaves of the sheet 25, travels between the anvils 53,54 and the horns 51,52 when the horns 51,52 are raised.

By using two welding horns 51,52 it is possible to achieve a greater length of weld than would be possible using only one horn, and hence deeper pockets containing longer springs may be formed.

The lower edge of each horn 51,52 is castellated. After each incremental travel of the sheet 25, the horns 51,52 are lowered and compress the two leaves of the sheet 25 together and join the two leaves in a weld. Because of the castellated form of the lower edge of each horn 51,52, the weld has the form of an interrupted, rather than continuous, line. This is found to confer greater tensile strength on the finished string of pocketed springs.

The upper surface of each of the anvils 53,54 carries a strip of polytetrafluoroethylene tape 55,56. This cushions the contact of the welding horns 51,52 with the fabric 25 and leads to more consistent weld formation and enables the use of lighter weight fabrics than would otherwise be the case.

Figure 6:
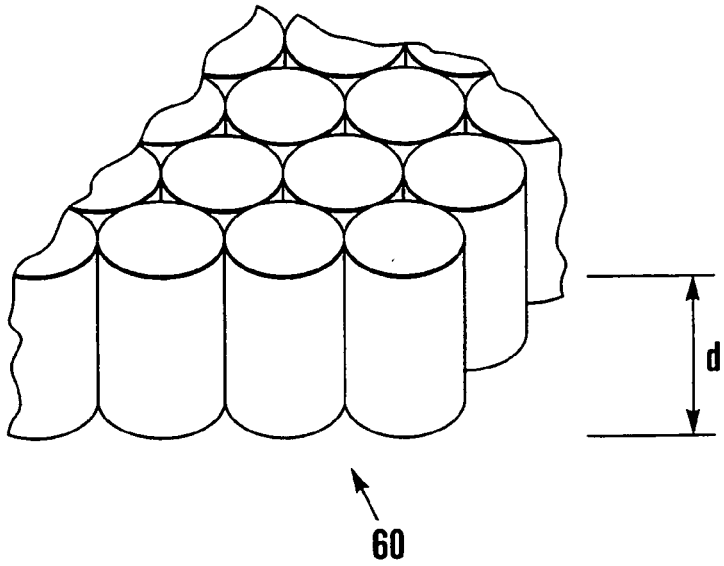
FIG. 6 is a partial perspective view of a pocketed spring assembly.

Referring finally to FIG. 6, a pocketed spring assembly 60 comprises strings of pocketed springs such as energe from the encapsulation unit 40 arranged side-by-side and fastened together to form a generally rectangular assembly. The strings of springs may be fastened together by any suitable means, eg gluing, stitching or mechanical fasteners. The depth d of the assembly 60 may be substantially greater than that of conventional pocketed spring assemblies.

What is claimed is:

1. An apparatus for the production of a pocketed coil spring having a predetermined spring profile, said apparatus comprising:

a coiling section in which the coil spring is formed from wire fed to the coiling section, said coiling section comprising a wire feed by which wire is drawn through said coiling section, a first coiling element which controls a diameter of the coil spring, a second coiling element which controls a pitch of the coil spring, a first drive by which first positions or first orientations of the first coiling element can be altered, a second drive by which second positions or second orientations of the second coiling element can be altered, an encapsulation section in which the coil spring is inserted between juxtaposed sheets of material and in which the sheets of material are joined together to form a pocket enclosing the coil spring, and a programmable control system operably linked to said first and second drives to alter the first positions or the first orientations of said first coiling element and the second positions or the second orientations of said second coiling element relative to the wire feed, said programmable control system comprising a plurality of stored data arrays or tables, each data array or table determines a plurality of the first positions or a plurality of the first orientations of said first coiling element and a plurality of the second positions or a plurality of the second orientations of said second coiling element for a particular coil spring profile.

2. Apparatus as claimed in claim 1, wherein the programmable control system comprises a programmable logic controller by which computer-numerical-control of the coiling section is achieved.

3. Apparatus as claimed in claim 2, wherein the programmable logic controller is operably linked to a third drive by which the wire feed can be controlled.

4. Apparatus as claimed in claim 3, wherein said first, second and third drives each comprise a servo-motor.

5. Apparatus as claimed in claim 1, wherein one or more electromagnets are mounted at the exit of the coiling section, said one or more electromagnets engaging each spring as it leaves the coiling section to substantially dampen excessive oscillation in each spring, said spring being mechanically drawn away from said one or more electromagnets as said spring is conveyed to the encapsulation section.

6. Apparatus as claimed in claim 1, wherein the programmable control system is also operably linked to the encapsulation section, to control movement of material through the encapsulation section.

7. Apparatus as claimed in claim 6, wherein a servo motor operably linked to the programmable control system controls movement of the material through the encapsulation section, such that said material is advanced in increments corresponding to a desired pocket width.

8. Apparatus as claimed in claim 1, wherein a mechanism by which the springs are transferred to the encapsulation section and inserted between the sheets of material comprises:

a rotating wheel with radially extending arms, successively formed springs being engaged by successive arms of said wheel;

a spring compression system that compresses the springs as they are conveyed to the encapsulation section on the arms of said rotating wheel; and a reciprocating cassette into which the compressed springs are delivered by said wheel and within which the compressed springs are transported to the encapsulation section.

9. Apparatus as claimed in claim 1, further comprising ultrasonic welding units by which the sheets of material are joined together to form pockets.

10. Apparatus as claimed in claim 9, wherein said ultrasonic welding units comprises longitudinal welding units arranged parallel to the longitudinal axis of the sheets of material and transverse welding units arranged transverse to said axis.

11. Apparatus as claim in claim 9, wherein said ultrasonic welding units comprises ultrasonic welding horns with castellated lower edges.

12. Apparatus as claimed in claim 10, wherein said transverse welding units comprises a pair of welding horns arranged colinearly.

13. Apparatus as claimed in claim 11, further comprising a positioning system that alters a position of the transverse welding units on said longitudinal axis of said sheets of material.

14. Apparatus as claimed in claim 9, wherein the ultrasonic welding units comprise ultrasonic welding horns, at least one of which acts against a fixed anvil provided with a surface coating which acts as a cushion for said welding horn.

15. Apparatus as claimed in claim 14, wherein said surface coating comprises a tape applied to the surface of the anvil.

16. Apparatus as claimed in claim 15, wherein said tape is a polytetrafluoroethylene tape.

17. Apparatus as claimed in claim 1, wherein said sheets of material are drawn through the encapsulation section by a pair of horizontally disposed rollers, at least one of which is driven by a servo motor controlled by the programmable control system.

18. Apparatus as claimed in claim 17, wherein said rollers have rubberised surfaces.

19. Apparatus as claimed in claim 1, wherein said encapsulation section further comprises a transport system for drawing said sheets of material incrementally through the encapsulation section and a welding system that welds the sheets of material together, wherein the transport system and the welding system are controlled by the programmable control system.

20. A method of producing a pocketed coil spring, the method comprising:

providing a programmable control system storing a plurality of data arrays or tables, wherein each of the data arrays or tables determine a plurality of positions or orientations of coiling elements for forming a particular spring profile, selecting a data array or table according to a desired spring profile, feeding wire through a coiling section so as to form a coil, wherein the programmable control system alters the positions or orientations of the coiling elements to control a diameter and a pitch of the coil according to the selected data array or table, separating said coil from said wire, compressing said coil, inserting said coil between juxtaposed sheets of material, and joining said sheets of material together so as to encapsulate said coil.

21. A method as claimed in claim 20, wherein the positions or orientations of each of the coiling elements are set by a server motor operating under control of the programmable control system.

* * * * *